US008057068B2

(12) United States Patent
Kwo

(10) Patent No.: US 8,057,068 B2
(45) Date of Patent: Nov. 15, 2011

(54) ARTIFICIAL LIGHT SOURCE GENERATOR

(75) Inventor: Jon-Lian Kwo, Tainan County (TW)

(73) Assignee: All Real Technology Co., Ltd., Tainan County (TW)

( * ) Notice: Subject to any disclaimer, the term of this patent is extended or adjusted under 35 U.S.C. 154(b) by 144 days.

(21) Appl. No.: 12/508,484

(22) Filed: Jul. 23, 2009

(65) Prior Publication Data

US 2010/0046229 A1 Feb. 25, 2010

(30) Foreign Application Priority Data

Aug. 21, 2008 (TW) ..... 97131925 A

(51) Int. Cl.
*F21S 8/00* (2006.01)

(52) U.S. Cl. ..... 362/263; 362/268; 362/331; 362/335; 362/296.09; 362/296.01

(58) Field of Classification Search ..... 362/263, 362/268, 296.01, 296.08, 296.09, 331, 335; 359/385; 353/38, 102
See application file for complete search history.

(56) References Cited

U.S. PATENT DOCUMENTS

| | | | | |
|---|---|---|---|---|
| 2,183,249 | A | 12/1939 | Schering et al. | |
| 2,236,420 | A * | 3/1941 | Bergmans et al. | 362/237 |
| 3,296,923 | A | 1/1967 | Miles | |
| 3,449,045 | A * | 6/1969 | Roux | 353/31 |
| 3,484,599 | A * | 12/1969 | Little | 362/268 |
| 3,513,306 | A | 5/1970 | Le Vantine | |
| 4,701,023 | A | 10/1987 | Hager et al. | |
| 5,418,583 | A * | 5/1995 | Masumoto | 353/38 |
| 5,626,409 | A * | 5/1997 | Nakayama et al. | 353/31 |
| 5,997,143 | A | 12/1999 | Derra et al. | |
| 6,204,972 | B1 * | 3/2001 | Itoh | 359/622 |
| 6,246,526 | B1 * | 6/2001 | Okuyama | 359/621 |

(Continued)

FOREIGN PATENT DOCUMENTS

CN 2593234 Y 12/2003

OTHER PUBLICATIONS

English translation and the Chinese Office Action dated Aug. 25, 2010 (previously submitted on Nov. 23, 2010) for CN200810168237.5, which is a corresponding Chinese application.

(Continued)

*Primary Examiner* — Diane Lee
*Assistant Examiner* — Jessica M Apenteng
(74) *Attorney, Agent, or Firm* — WPAT, P.C.; Anthony King

(57) ABSTRACT

An artificial light source generator includes at least one luminescent set and a projection plane. The luminescent set includes a light source, a parabolic mirror, a supporting seat, a first lens array, and a second lens array. The light source is disposed at the focus of the parabolic mirror, so that light beams generated by the light source are transmitted in a parallel direction through the parabolic mirror. The supporting seat is for supporting the light source. The first lens array has a plurality of first lens units, and each of the first lens units has a first focal distance. The second lens array has a plurality of second lens units. The distance between the second lens array and the first lens array is 0.5 to 1.5 times the first focal distance. A suitable distance exists between the projection plane and the luminescent set, so that the light beams passing through each of the second lens units cover the entire projection plane. Therefore, the projection plane has excellent illumination uniformity.

33 Claims, 6 Drawing Sheets

U.S. PATENT DOCUMENTS

| | | | | |
|---|---|---|---|---|
| 6,315,417 | B1 * | 11/2001 | Yajima et al. | 353/122 |
| 6,499,845 | B2 * | 12/2002 | Sato | 353/38 |
| 6,552,760 | B1 * | 4/2003 | Gotoh et al. | 349/56 |
| 6,585,397 | B1 * | 7/2003 | Ebiko | 362/297 |
| 6,669,345 | B2 * | 12/2003 | Yajima | 353/38 |
| 6,877,882 | B1 * | 4/2005 | Haven et al. | 362/308 |
| 6,921,188 | B2 * | 7/2005 | Taniuchi | 362/517 |
| 7,864,429 | B2 * | 1/2011 | Muenz et al. | 359/626 |
| 2001/0035940 | A1 * | 11/2001 | Bierhuizen | 353/20 |
| 2001/0053078 | A1 * | 12/2001 | Ishikawa et al. | 362/238 |
| 2002/0008972 | A1 * | 1/2002 | Dewald | 362/268 |
| 2005/0248736 | A1 * | 11/2005 | Itoh | 353/102 |
| 2005/0265027 | A1 * | 12/2005 | Wu et al. | 362/293 |
| 2006/0209310 | A1 * | 9/2006 | Muenz et al. | 356/521 |

OTHER PUBLICATIONS

Search Report by the EPO dated Mar. 8, 2011 for 09166944.0, which is a corresponding European application, that cites US5418583, US4701023, US3296923, US5997143, US3513306, and US2183249.

* cited by examiner

ARTIFICIAL LIGHT SOURCE GENERATOR

BACKGROUND OF THE INVENTION

1. Field of the Invention

The present invention relates to an artificial light source generator, and more particularly to an artificial light source generator capable of simulating natural light in a large area.

2. Description of the Related Art

As public awareness about environmental protection and energy conservation is on the rise, many efforts are being made to developed solar cell modules. However, one of the major challenges for development of solar cell module is testing after manufacturing. The intensity of natural light (sunlight) changes at different points of a day and is difficult to control artificially, so solar cell modules are generally not placed outdoors for testing. In conventional testing, an artificial light source is used indoors to simulate sunlight, so as to obtain relevant product characteristics of the solar cell modules.

Two conventional testing methods are described below. In the first method, a flash xenon lamp is used with a flash time of about tens of milliseconds each time, which covers a flash area of more than 1*1 square meter, and can meet the uniformity requirements by means of the profile design of lighting fixtures and lamps. The disadvantage of this method is that the flash time is too short, so it is difficult to obtain correct or sufficient voltage and current data. Further, light soaking or hot spot tests that require light irradiation for a long time cannot be performed in this testing method.

FIG. 1 shows a schematic view of a projection plane in the second conventional testing method. A plurality of sets of continuum lamps (for example, 6 sets) is used for irradiation, so as to form six illumination regions 11 on a projection plane 10. The lamps may be tungsten lamps, metal-composite lamps, xenon lamps, or other light sources capable of emitting lights stably and achieving a required spectrum after being filtered by a filter mirror. The lamps are arranged adjacent to one another in a specific manner so that the illumination uniformity of the projection plane 10 meets certain requirements. If necessary, a shading material (for example, wire net) is applied between the lamps and the projection plane 10, so as to reduce the light on a certain region to meet the illumination uniformity required for the whole projection plane 10.

The disadvantage of this method is that the position and intensity of each lamp and the density of the wire net must be adjusted to achieve the required uniformity, which is rather difficult and labor-consuming. Generally, it takes about ten days to make one adjustment. Whenever the attenuation of a certain lamp differs from that of the other lamps, the adjustment must be made again. For example, if the lamp on the top left corner of the illumination region 11 is attenuated too fast, the illumination region 11 will be darker than the other illumination regions, and a readjustment will be needed. In addition, if the overall uniformity deteriorates due to the shift of a certain component, a readjustment will also be needed.

Therefore, it is necessary to provide an artificial light source generator to solve the above problems.

SUMMARY OF THE INVENTION

The present invention is directed to an artificial light source generator, which includes at least one luminescent set and a projection plane. The luminescent set includes a light source, a parabolic mirror, a supporting seat, a first lens array, and a second lens array. The light source is used to generate light beams. The parabolic mirror has a focus, and the light source is disposed at the focus, so that the light beams generated by the light source are transmitted in a parallel direction through the parabolic mirror. The supporting seat is used for supporting the light source. The first lens array has a plurality of first lens units, and each of the first lens units has a first focal distance. The second lens array has a plurality of second lens units, and the second lens array is parallel to the first lens array. The distance between the second lens array and the first lens array is 0.5 to 1.5 times the first focal distance. The projection plane is used for placing a module being tested. The projection plane is separated from the luminescent set at a suitable distance, so that the light beams passing through the first lens array and the second lens array are projected on the projection plane. The light beams passing through each of the second lens units cover the entire projection plane.

The present invention has the following advantages. A non-uniformity performance of under 5% is achieved when a single luminescent set is used to project light beams on the projection plane, and more preferred overall illumination uniformity can be achieved when a plurality of luminescent sets is used to project light beams on the projection plane. Furthermore, the uniformity will not deteriorate due to an output attenuation of a certain luminescent set. In addition, when a plurality of luminescent sets is employed for irradiation in an overlapping manner, each luminescent set can adopt a different light source or filter mirror to produce light beams at different wavelengths, so as to generate a composite spectrum on the projection plane. If different luminance is required, a part of the luminescent sets can be shaded or turned off without affecting the illumination uniformity on the projection plane.

DETAILED DESCRIPTION OF THE INVENTION

Figure 1:
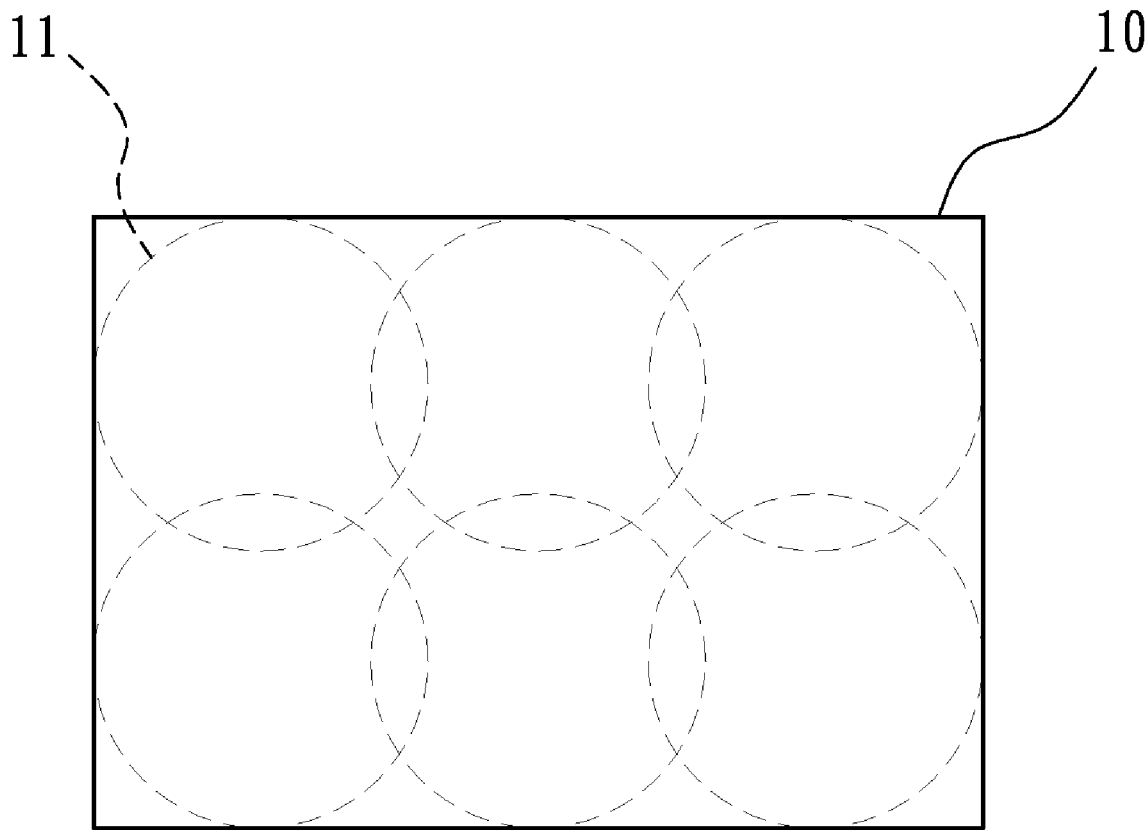
FIG.1 (Prior Art)
FIG. 1 is a schematic view of a projection plane in a second conventional testing method.
Figure 2:
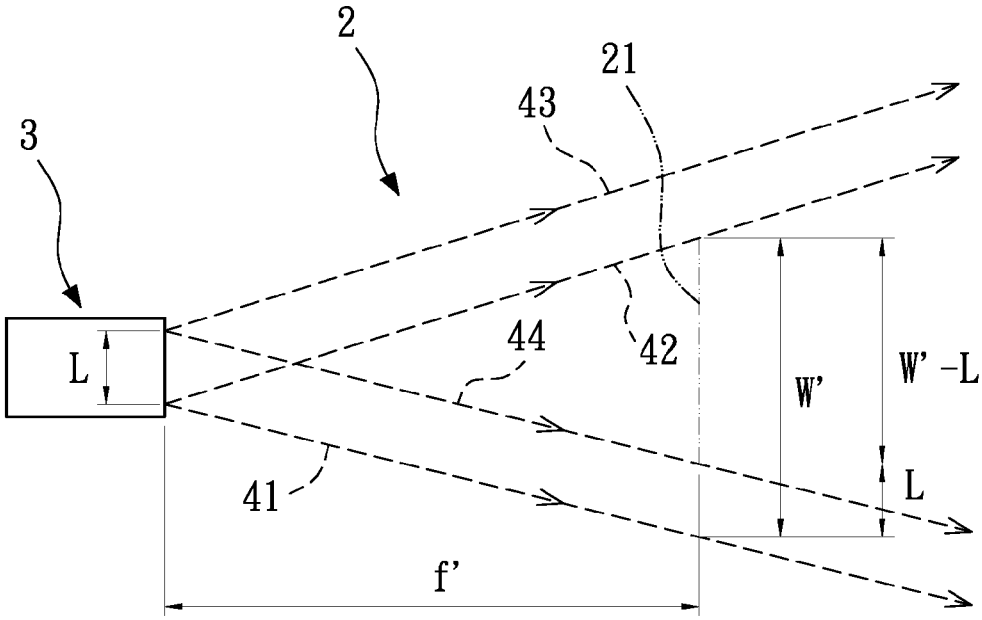
FIG. 2 is a schematic view of an artificial light source generator according to a first embodiment of the present invention.
Figure 3:
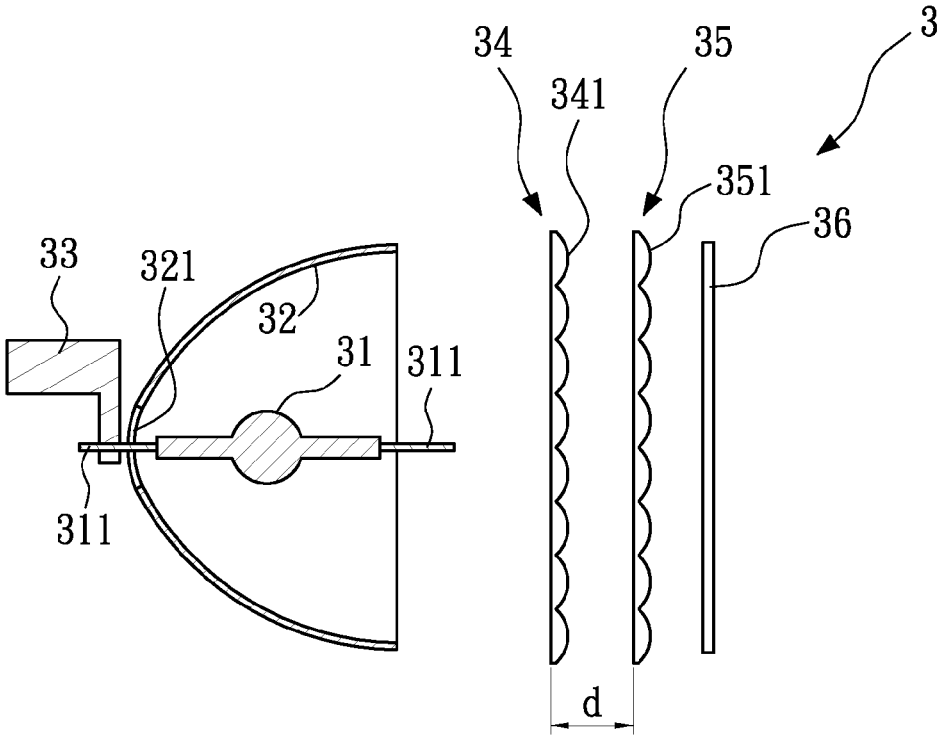
FIG. 3 is a schematic view of a luminescent set in the artificial light source generator according to the first embodiment of the present invention.

FIGS. 2 and 3 show schematic views of an artificial light source generator and a luminescent set thereof according to a first embodiment of the present invention. The artificial light source generator 2 of the present invention can be used indoors to simulate sunlight, so as to test the solar cell products to obtain information about relevant product characteristics. However, it should be understood that the artificial light source generator 2 of the present invention can also be applied in other circumstances that requires uniform light beams. The artificial light source generator 2 includes at least one luminescent set 3 and a projection plane 21. As shown in FIG. 3, the luminescent set 3 includes a light source 31, a parabolic mirror 32, a supporting seat 33, a first lens array 34, a second lens array 35, and a filter mirror 36.

The light source 31 is used to generate light beams. In this embodiment, the light source 31 is a xenon lamp having two terminal electrodes 311. The terminal electrodes 311 are connected to a power source, and the power source provides a voltage and a current required for turning on the light source 31.

The parabolic mirror 32 has a focus, and the light source 31 is disposed at the focus, so that the light beams generated by the light source are transmitted in a parallel direction through the parabolic mirror 32. Preferably, the parabolic mirror 32 is attached to a lamp shade.

The supporting seat 33 is used to support the light source 31. In this embodiment, the parabolic mirror 32 further includes an opening 321, and one end of the light source 31 passes through the opening 321 and is fastened on the supporting seat 33.

The first lens array 34 has a plurality of first lens units 341, and each of the first lens units 341 has a first focal distance. The first lens units 341 may be separate and independent of each other or integrally formed. The second lens array 35 has a plurality of second lens units 351, and each of the second lens units 351 has a second focal distance. The second lens units 351 may be separate and independent of each other or integrally formed. It should be noted that the number of the lens arrays in the present invention is not limited to two and may also be three or more.

Preferably, the second focal distance is equal to the first focal distance, the profile of the second lens units 351 is the same as that of the first lens units 341, and the positions of the second lens units 351 correspond to those of the first lens units 341.

The second lens array 35 is parallel to the first lens array 34, and a distance d between the second lens array 35 and the first lens array 34 is 0.5 to 1.5 times the first focal distance. Preferably, the distance d between the second lens array 35 and the first lens array 34 is equal to the first focal distance.

The projection plane 21 is used for placing a module being tested (for example, a solar cell module) (not shown). The projection plane 21 is separated from the luminescent set 3 at a suitable distance, so that the light beams passing through the first lens array 34 and the second lens array 35 are projected on the projection plane 21, and the light beams passing through each of the second lens units 351 cover the entire projection plane 21.

Figure 4:
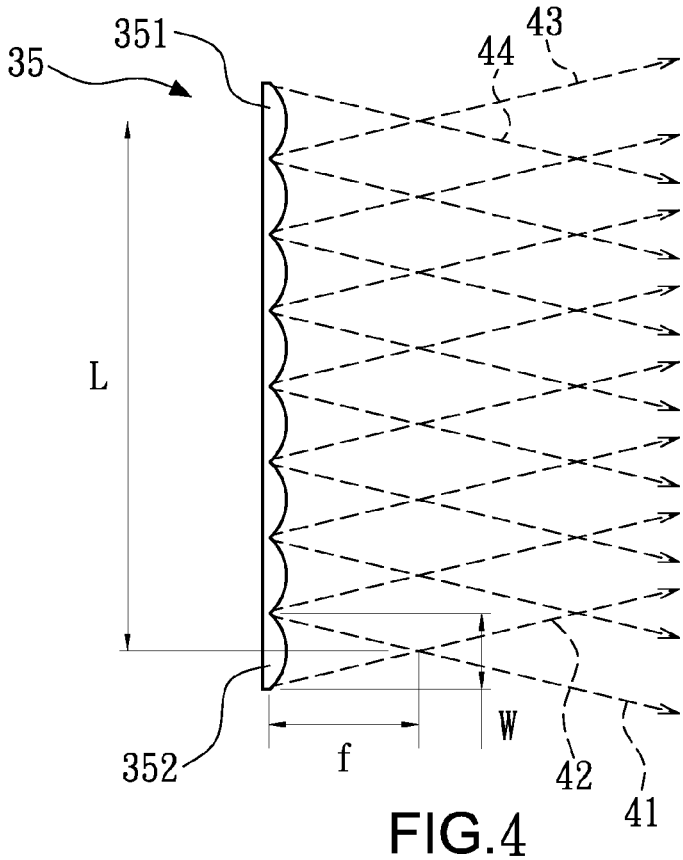
FIG. 4 is a schematic view of light paths of a second lens array in the artificial light source generator according to the present invention.

FIG. 4 shows a schematic view of light paths of the second lens array in the artificial light source generator according to the present invention.

The second lens unit 351 at an uppermost position and the second lens unit 352 at a lowermost position of the second lens array 35 are taken as an example below. When the light beams pass through the second lens unit 352 at the lowermost position, the light beams are first concentrated to a focus thereof and then diverged outwards, as indicated by a first light path 41 and a second light path 42. The first light path 41 indicates a lower edge after the light beams pass through the focus, and the second light path 42 indicates an upper edge after the light beams pass through the focus. The distance between the focus and the second lens unit 352 is the second focal distance f, and the second lens unit 352 has a width W.

Similarly, when the light beams pass through the second lens unit 351 at the uppermost position, the light beams are first concentrated to a focus thereof and then diverged outwards, as indicated by a third light path 43 and a fourth light path 44. The third light path 43 indicates an upper edge after the light beams pass through the focus, and the fourth light path 44 indicates a lower edge after the light beams pass through the focus. The focus of the second lens unit 351 at the uppermost position and the focus of the second lens unit 352 at the lowermost position are spaced apart at a distance L, and the distance L is slightly shorter than the width of the second lens array 35. In a preferred embodiment, the distance L falls between 150 mm and 500 mm, and the distance between a focus of the first lens unit at an uppermost position and a focus of the first lens unit at a lowermost position of the first lens array 34 also falls between 150 mm and 500 mm.

In FIG. 2, the projection plane 21 is separated from the luminescent set 3 at a distance f', a region on the projection plane 21 where the light beams passing through the second lens unit 352 at the lowermost position are projected has a width W', and W:f=W':f'. In a preferred embodiment, the distance f' falls between 5 m and 20 m. The projection plane 21 is a region below the second light path 42 and above the fourth light path 44, and has a width of W'-L, that is, the light beams passing through each of the second lens units 351 will cover the entire projection plane 21. Therefore, the projection plane 21 has desirable illumination uniformity, and the shape of the projection plane 21 is the same as that of the second lens units 351. Generally, the distance between the projection plane 21 and the second lens array 35 is 50 to 300 times, preferably 100 to 150 times, the first focal distance. As shown in FIG. 2, if the projection plane 21 moves towards the luminescent set 3, the area thereof is reduced, but the specific energy of the light beams is increased; if the projection plane 21 moves away from the luminescent set 3, the area thereof is enlarged, but the specific energy of the light beams is reduced.

Figure 5:
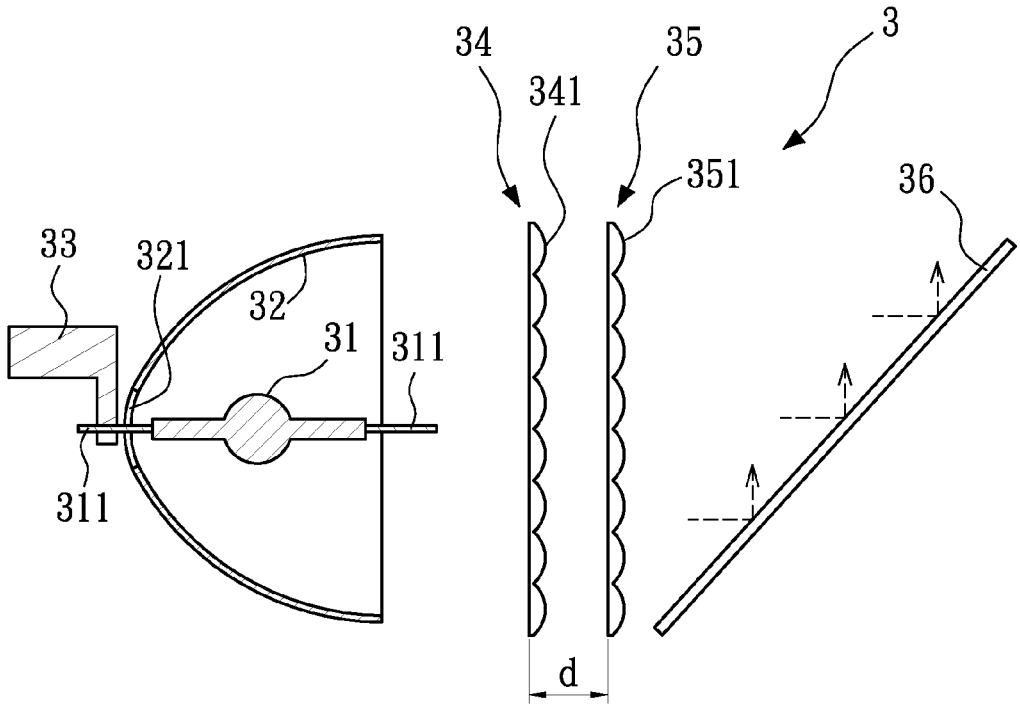
FIG. 5 is a schematic view of another implementation aspect of the artificial light source generator according to the first embodiment of the present invention, in which an angle is formed between the filter mirror and the second lens array.

With reference to FIG. 3 again, preferably, the luminescent set 3 further includes a filter mirror 36 disposed between the second lens array 35 and the projection plane 21. The filter mirror 36 is parallel to the second lens array 35, filters the light beams passing through the second lens array 35, and is capable of selectively letting the light beams within a specific required range of wavelengths pass through. In other applications, an angle is formed between the filter mirror 36 and the second lens array 35, as shown in FIG. 5, and the filter mirror 36 is used to reflect the light beams passing through the second lens array 35.

In another preferred embodiment, the filter mirror 36 is a coating that is coated on one or all of the parabolic mirror 32, the first lens array 34, and the second lens array 35.

Figure 6:
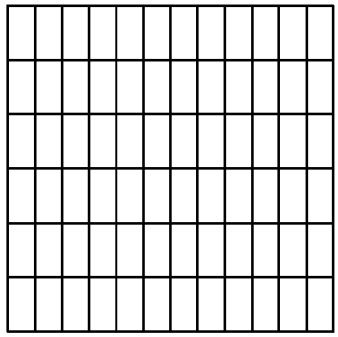
FIG. 6 shows a profile of the first lens units and the second lens units according to the first embodiment of the present invention, in which the profile is rectangular.
Figure 7:
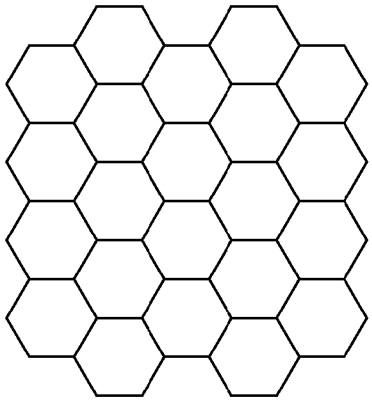
FIG. 7 shows a profile of the first lens units and the second lens units according to the first embodiment of the present invention, in which the profile is hexagonal.
Figure 8:
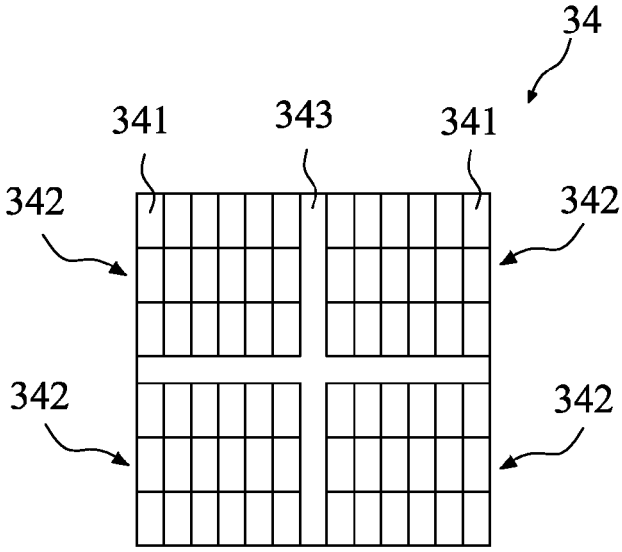
FIG. 8 shows a profile of the first lens units and the second lens units according to the first embodiment of the present invention, in which the first lens units and the second lens units are divided into four regions where lenses are gathered.

FIGS. 6 to 8 show schematic views of a profile of the lens units according to the present invention. In the present invention, the first lens units 341 may be single-convex lenses or double-convex lenses, and the second lens units 351 may be single-convex lenses or double-convex lenses. Preferably, the first lens units 341 and the second lens units 351 are spherical lenses. Seen from the front side, the profile of the first lens units 341 and the second lens units 351 is rectangular (as shown in FIG. 6) or hexagonal (as shown in FIG. 7). Alternatively, the first lens units 341 and the second lens units 351 may be divided into a plurality of regions (for example, four as shown in FIG. 8) where the lenses are gathered, and these regions are spaced apart by a shading material. As shown in FIG. 8, the first lens units 341 of the first lens array 34 are divided into four regions 342 where the lenses are gathered, and the regions 342 are spaced apart by a shading material 343. The shading material 343 is in a cris-cross shape.

Figure 9:
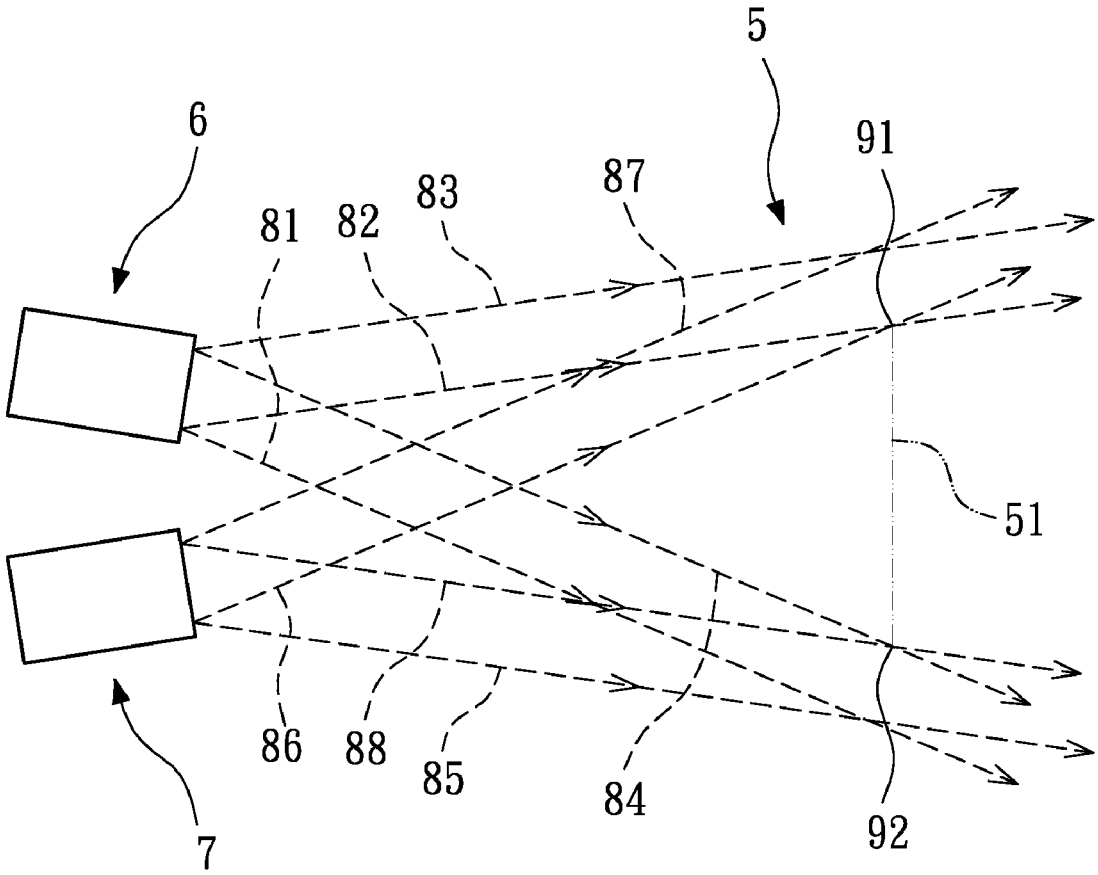
FIG. 9 is a schematic view of an artificial light source generator according to a second embodiment of the present invention.
Figure 10:
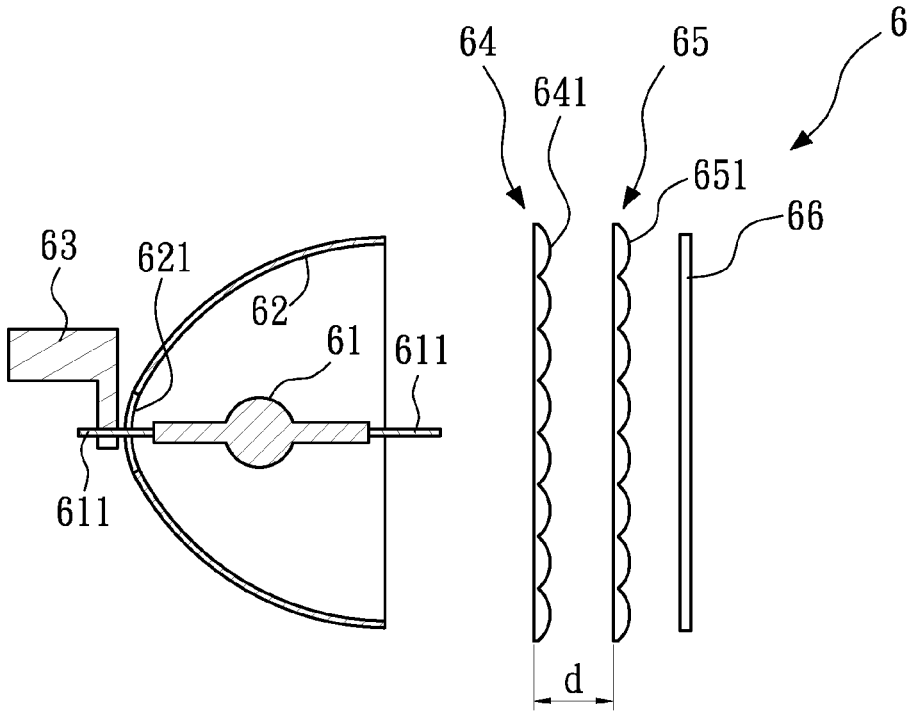
FIG. 10 is a schematic view of a first luminescent set in the artificial light source generator according to the second embodiment of the present invention.
Figure 11:
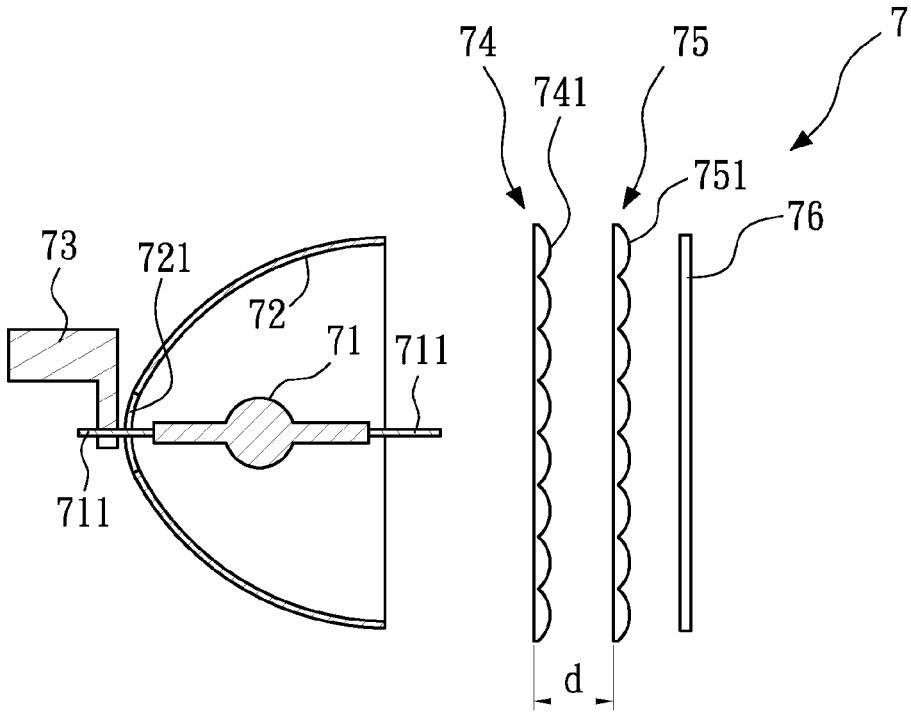
FIG. 11 is a schematic view of a second luminescent set in the artificial light source generator according to the second embodiment of the present invention.

FIGS. 9 to 11 show schematic views of an artificial light source generator and a first luminescent set and a second luminescent set thereof according to a second embodiment of the present invention. The artificial light source generator 5 includes a first luminescent set 6, a second luminescent set 7, and a projection plane 51. In this embodiment, the first luminescent set 6 and the second luminescent set 7 are the same as the luminescent set 3 in the first embodiment, and an angle is formed between the first luminescent set 6 and the second luminescent set 7. It should be understood that the first luminescent set 6 may also be different from the second luminescent set 7, and the artificial light source generator 5 may include more than three luminescent sets.

As shown in FIG. 10, the first luminescent set 6 includes a first light source 61, a first parabolic mirror 62, a first supporting seat 63, a first lens array 64, a second lens array 65, and a first filter mirror 66. The first light source 61 is used to generate first light beams. In this embodiment, the first light source 61 is a xenon lamp having two terminal electrodes 611. The terminal electrodes 611 are connected to a power source, and the power source provides a voltage and a current required for turning on the light source 61.

The first parabolic mirror 62 has a focus, and the first light source 61 is disposed at the focus, so that the first light beams generated by the first light source 61 are transmitted in a parallel direction through the first parabolic mirror 62. The first supporting seat 63 is for supporting the first light source 61. In this embodiment, the first parabolic mirror 62 further includes a first opening 621, and one end of the first light source 61 passes through the first opening 621 and is fastened on the first supporting seat 63.

The first lens array 64 has a plurality of first lens units 641, and each of the first lens units 641 has a first focal distance. The first lens units 641 may be separate and independent of each other or integrally formed. The second lens array 65 has a plurality of second lens units 651, and each of the second lens units 651 has a second focal distance. The second lens units 651 may be separate and independent of each other or integrally formed.

Preferably, the second focal distance is equal to the first focal distance. The profile of the second lens units 651 is the same as that of the first lens units 641, and the positions of the second lens units 651 correspond to those of the first lens units 641. The second lens array 65 is parallel to the first lens array 64, and a distance d between the second lens array 65 and the first lens array 64 is 0.5 to 1.5 times the first focal distance. Preferably, the distance d between the second lens array 65 and the first lens array 64 is equal to the first focal distance.

The first filter mirror 66 is disposed between the second lens array 65 and the projection plane 51. The first filter mirror 66 is parallel to the second lens array 65 and used filter the first light beams passing through the second lens array 65. In a preferred embodiment, the first filter mirror 66 is a coating that is coated on one or all of the first parabolic mirror 62, the first lens array 64, and the second lens array 65.

In FIG. 11, the second luminescent set 7 includes a second light source 71, a second parabolic mirror 72, a second supporting seat 73, a third lens array 74, a fourth lens array 75, and a second filter mirror 76. The second light source 71 is used to generate second light beams. In this embodiment, the second light source 71 is a xenon lamp having two terminal electrodes 711. The terminal electrodes 711 are connected to a power source, and the power source provides a voltage and a current required for turning on the second light source 71.

The second parabolic mirror 72 has a focus, and the second light source 71 is disposed at the focus, so that the second light beams generated by the second light source 71 are transmitted in a parallel direction through the second parabolic mirror 72. The second supporting seat 73 is for supporting the second light source 71. In this embodiment, the second parabolic mirror 72 further includes a second opening 721, and one end of the second light source 71 passes through the second opening 721 and is fastened on the second supporting seat 73.

The third lens array 74 has a plurality of third lens units 741, and each of the third lens units 741 has a third focal distance. The third lens units 741 may be separate and independent of each other or formally integrally. The fourth lens array 75 has a plurality of fourth lens units 751, and each of the fourth lens units 751 has a fourth focal distance. The fourth lens units 751 may be separate and independent of each other or integrally formed.

Preferably, the fourth focal distance is equal to the third focal distance. The profile of the fourth lens units 751 is the same as that of the third lens units 741, and the positions of the fourth lens units 751 correspond to those of the third lens units 741. The fourth lens array 75 is parallel to the third lens array 74, and a distance d between the fourth lens array 75 and the third lens array 74 is 0.5 to 1.5 times the third focal distance. Preferably, the distance d between the fourth lens array 75 and the third lens array 74 is equal to the third focal distance.

The second filter mirror 76 is disposed between the fourth lens array 75 and the projection plane 51. The second filter mirror 76 is parallel to the fourth lens array 75 and used to filter the second light beams passing through the fourth lens array 75. In a preferred embodiment, the second filter mirror 76 is a coating coated on one or all of the second parabolic mirror 72, the third lens array 74, and the fourth lens array 75.

With reference to FIG. 9 again, the projection plane 51 is used for placing a module being tested (for example, a solar cell module) (not shown). The first luminescent set 6 and the second luminescent set 7 are separated from the projection plane 51 at a suitable distance, so that the first light beams passing through the first lens array 64 and the second lens array 65 (as shown in FIG. 10) are projected on the projection plane 51, and the second light beams passing through the third lens array 74 and the fourth lens array 75 (as shown in FIG. 11) are projected on the projection plane 51. The first light beams passing through each of the second lens units 651 cover the entire projection plane 51, and the second light beams passing through each of the fourth lens units 751 cover the entire projection plane 51.

The light paths in this embodiment are described below. When the first light beams pass through the second lens unit at a lowermost position of the second lens array 65, the first light beams are first concentrated to a focus thereof and then diverged outwards, as indicated by a first light path 81 and a second light path 82. The first light path 81 indicates a lower edge after the first light beams pass through the focus, and the second light path 82 indicates an upper edge after the first light beams pass through the focus. When the first light beams pass through the second lens unit at an uppermost position of the second lens array 65, the first light beams are first concentrated to a focus thereof and then diverged outwards, as indicated by a third light path 83 and a fourth light path 84. The third light path 83 indicates an upper edge after the first light beams pass through the focus, and the fourth light path 84 indicates a lower edge after the first light beams pass through the focus.

Similarly, when the second light beams pass through the fourth lens unit at a lowermost position of the fourth lens array 75, the second light beams are first concentrated to a focus thereof and then diverged outwards, as indicated by a fifth light path 85 and a sixth light path 86. The fifth light path 85 indicates a lower edge after the second light beams pass through the focus, and the sixth light path 86 indicates an upper edge after the second light beams pass through the focus. When the second light beams pass through the fourth lens unit at an uppermost position of the fourth lens array 75, the second light beams are first concentrated to a focus thereof and then diverged outwards, as indicated by a seventh light path 87 and an eighth light path 88. The seventh light path 87 indicates an upper edge after the second light beams pass through the focus, and the eighth light path 88 indicates a lower edge after the second light beams pass through the focus.

The second light path 82 and the sixth light path 86 intersect at a first crosspoint 91, the fourth light path 84 and the eighth light path 88 intersect at a second crosspoint 92, and the projection plane 51 is disposed between the first crosspoint 91 and the second crosspoint 92. Thus, the light beams passing through each of the second lens units 651 and each of the fourth lens units 751 cover the entire projection plane 51. Therefore, the projection plane 51 has desirable illumination uniformity. Generally, the distance between the projection plane 51 and the second lens array 65 is 50 to 300 times, preferably 100 to 150 times, the first focal distance.

In this embodiment, the first lens units 641, the second lens units 651, the third lens units 741, and the fourth lens units 751 may be single-convex lenses or double-convex lenses. Preferably, these lens units are spherical lenses. Seen from the front side, the profile of the first lens units 641, the second lens units 651, the third lens units 741, and the fourth lens units 751 is rectangular or hexagonal. Alternatively, the first lens units 641, the second lens units 651, the third lens units 741, and the fourth lens units 751 may be divided into a plurality of regions where the lenses are gathered, and these regions are spaced apart by a shading material.

The present invention has the following advantages. A non-uniformity performance of over 5% is achieved when a single luminescent set 3 is used to project light beams on the projection plane 21 (such as the artificial light source generator 2 in the first embodiment shown in FIG. 2), and more preferred overall illumination uniformity can be achieved when a plurality of luminescent sets 6 and 7 is used to project light beams on the projection plane 51 (such as the artificial light source generator 5 in the second embodiment shown in FIG. 9). Furthermore, the uniformity will not deteriorate due to an output attenuation of a certain luminescent set. In addition, when a plurality of luminescent sets is employed for irradiation in an overlapping manner, each luminescent set can adopt a different light source or filter mirror to produce light beams at different wavelengths, so as to generate a composite spectrum on the projection plane. If different luminance is required, a part of the luminescent sets can be shaded or turned off without affecting the illumination uniformity on the projection plane.

While several embodiments of the present invention have been illustrated and described, various modifications and improvements can be made by those skilled in the art. The embodiments of the present invention are therefore described in an illustrative but not restrictive sense. It is intended that the present invention should not be limited to the particular forms as illustrated, and that all modifications which maintain the spirit and scope of the present invention are within the scope defined in the appended claims.

What is claimed is:

1. An artificial light source generator, comprising:

at least one luminescent set, comprising:

a light source, for generating light beams;

a parabolic mirror, having a focus, wherein the light source is disposed at the focus, so that the light beams generated by the light source are transmitted in a parallel direction through the parabolic mirror;

a supporting seat, for supporting the light source;

a first lens array, having a plurality of first lens units, wherein each of the first lens units has a first focal distance; and a second lens array, having a plurality of second lens units, wherein the second lens array is parallel to the first lens array, and the distance between the second lens array and the first lens array is 0.5 to 1.5 times the first focal distance, wherein the first lens units and the second lens units are divided into a plurality of regions where lenses are gathered, and the regions where the lenses are gathered are spaced apart by a shading material, wherein each of the plurality of regions of the first lens units and the second lens units is spaced apart by the shading material in a cris-crossing configuration; and a projection plane, for placing a module being tested, wherein the projection plane is separated from the luminescent set at a suitable distance, so that the light beams passing through the first lens array and the second lens array are projected on the projection plane, and the light beams passing through each of the second lens units cover the entire projection plane.

2. The artificial light source generator according to claim 1, wherein the light source is a xenon lamp.

3. The artificial light source generator according to claim 1, wherein the light source further comprises two terminal electrodes.

4. The artificial light source generator according to claim 1, wherein the parabolic mirror further comprises an opening, and one end of the light source passes through the opening and is fastened on the supporting seat.

5. The artificial light source generator according to claim 1, wherein each of the second lens units has a second focal distance, the second focal distance is equal to the first focal distance, the profile of the second lens units is the same as that of the first lens units, and the positions of the second lens units correspond to those of the first lens units.

6. The artificial light source generator according to claim 1, wherein the first lens units are separate and independent of each other.

7. The artificial light source generator according to claim 1, wherein the first lens units are integrally formed.

8. The artificial light source generator according to claim 1, wherein the second lens units are separate and independent of each other.

9. The artificial light source generator according to claim 1, wherein the second lens units are integrally formed.

10. The artificial light source generator according to claim 1, wherein the luminescent set further comprises a filter mirror.

11. The artificial light source generator according to claim 10, wherein the filter mirror is parallel to the second lens array and used to filter the light beams passing through the second lens array.

12. The artificial light source generator according to claim 10, wherein an angle is formed between the filter mirror and the second lens array, and the filter mirror is used to reflect the light beams passing through the second lens array.

13. The artificial light source generator according to claim 10, wherein the filter mirror is a coating that is coated on one or all of the parabolic mirror, the first lens array, and the second lens array.

14. The artificial light source generator according to claim 1, wherein the distance between the second lens array and the first lens array is equal to the first focal distance.

15. The artificial light source generator according to claim 1, wherein the distance between the projection plane and the second lens array is 50 to 300 times the first focal distance.

16. The artificial light source generator according to claim 1, wherein the first lens units and the second lens units are spherical lenses.

17. The artificial light source generator according to claim 1, wherein the first lens units are single-convex lenses or double-convex lenses.

18. The artificial light source generator according to claim 1, wherein the second lens units are single-convex lenses or double-convex lenses.

19. The artificial light source generator according to claim 1, wherein the profile of the first lens units and the second lens units is rectangular or hexagonal.

20. The artificial light source generator according to claim 1, wherein when the light beams pass through the second lens unit at a lowermost position of the second lens array, the light beams are first concentrated to a focus thereof and then diverged outwards, a lower edge thereof is defined as a first light path, and an upper edge thereof is defined as a second light path; when the light beams pass through the second lens unit at an uppermost position of the second lens array, the light beams are first concentrated to a focus thereof and then diverged outwards, an upper edge thereof is defined as a third light path, and a lower edge thereof is defined as a fourth light path; and the projection plane is a region below the second light path and above the fourth light path.

21. An artificial light source generator, comprising:

a first luminescent set, comprising:

a first light source, for generating first light beams;

a first parabolic mirror, having a first focus, wherein the first light source is disposed at the first focus, so that the first light beams generated by the first light source are transmitted in a parallel direction through the first parabolic mirror;

a first supporting seat, for supporting the first light source;

a first lens array, having a plurality of first lens units, wherein each of the first lens units has a first focal distance; and a second lens array, having a plurality of second lens units, wherein the second lens array is parallel to the first lens array, and the distance between the second lens array and the first lens array is 0.5 to 1.5 times the first focal distance, wherein the first lens units and the second lens units are divided into a plurality of regions where lenses are gathered, and the regions where the lenses are gathered are spaced apart by a shading material, wherein each of the plurality of regions of the first lens units and the second lens units is spaced apart by the shading material in a cris-crossing configuration;

a second luminescent set, forming an angle with the first luminescent set, the second luminescent set comprising:

a second light source, for generating second light beams;

a second parabolic mirror, having a second focus, wherein the second light source is disposed at the second focus, so that the second light beams generated by the second light source are transmitted in a parallel direction through the second parabolic mirror;

a second supporting seat, for supporting the second light source;

a third lens array, having a plurality of third lens units, wherein each of the third lens units has a third focal distance; and a fourth lens array, having a plurality of fourth lens units, wherein the fourth lens array is parallel to the third lens array, and the distance between the fourth lens array and the third lens array is 0.5 to 1.5 times the third focal distance; and a projection plane, for placing a module being tested, wherein the projection plane is separated from the first luminescent set and the second luminescent set at a suitable distance, so that the first light beams passing through the first lens array and the second lens array are projected on the projection plane, the second light beams passing through the third lens array and the fourth lens array are projected on the projection plane, the first light beams passing through each of the second lens units cover the entire projection plane, and the second light beams passing through each of the fourth lens units cover the entire projection plane.

22. The artificial light source generator according to claim 21, wherein the first light source and the second light source are xenon lamps.

23. The artificial light source generator according to claim 21, wherein the first parabolic mirror further comprises a first opening, and one end of the first light source passes through the first opening and is fastened on the first supporting seat.

24. The artificial light source generator according to claim 21, wherein each of the second lens units has a second focal distance, the second focal distance is equal to the first focal distance, the profile of the second lens units is the same as that of the first lens units, and positions of the second lens units correspond to those of the first lens units.

25. The artificial light source generator according to claim 21, wherein each of the fourth lens units has a fourth focal distance, the fourth focal distance is equal to the third focal distance, the profile of the fourth lens units is the same as that of the third lens units, and positions of the fourth lens units correspond to those of the third lens units.

26. The artificial light source generator according to claim 21, wherein the first luminescent set further comprises a first filter mirror located between the second lens array and the projection plane, for filtering the first light beams passing through the second lens array, and the second luminescent set further comprises a second filter mirror located between the fourth lens array and the projection plane, for filtering the second light beams passing through the fourth lens array.

27. The artificial light source generator according to claim 21, wherein the first luminescent set further comprises a first filter mirror, the first filter mirror is a coating that is coated on one or all of the first parabolic mirror, the first lens array, and the second lens array; and the second luminescent set further comprises a second filter mirror, the second filter mirror is a coating that is coated on one or all of the second parabolic mirror, the third lens array, and the fourth lens array.

28. The artificial light source generator according to claim 21, wherein the distance between the second lens array and the first lens array is equal to the first focal distance, and the distance between the fourth lens array and the third lens array is equal to the third focal distance.

29. The artificial light source generator according to claim 21, wherein a distance between the projection plane and the second lens array is 50 to 300 times the first focal distance and a distance between the projection plane and the fourth lens array is 50 to 300 times the third focal distance.

30. The artificial light source generator according to claim 21, wherein the first lens units, the second lens units, the third lens units, and the fourth lens units are spherical lenses.

31. The artificial light source generator according to claim 21, wherein the first lens units, the second lens units, the third lens units, and the fourth lens units are single-convex lenses or double-convex lenses.

32. The artificial light source generator according to claim 21, wherein a profile of the first lens unit, the second lens units, the third lens units, and the fourth lens units is rectangular or hexagonal.

33. The artificial light source generator according to claim 21, wherein when the first light beams pass through the second lens unit at a lowermost position of the second lens array, the first light beams are first concentrated to a focus thereof and then diverged outwards, a lower edge thereof is defined as a first light path, and an upper edge thereof is defined as a second light path; when the first light beams pass through the second lens unit at an uppermost position of the second lens array, the first light beams are first concentrated to a focus thereof and then diverged outwards, an upper edge thereof is defined as a third light path, and a lower edge thereof is defined as a fourth light path; when the second light beams pass through the fourth lens unit at a lowermost position of the fourth lens array, the second light beams are first concentrated to a focus thereof and then diverged outwards, a lower edge thereof is defined as a fifth light path, and an upper edge thereof is defined as a sixth light path; and when the second light beams pass through the fourth lens unit at an uppermost position of the fourth lens array, the second light beams are first concentrated to a focus thereof and then diverged outwards, an upper edge thereof is defined as a seventh light path, and a lower edge thereof is defined as an eighth light path; the second light path and the sixth light path intersect at a first crosspoint; the fourth light path and the eighth light path intersect at a second crosspoint;

and the projection plane is disposed between the first crosspoint and the second crosspoint.

* * * * *